US007968266B2

(12) United States Patent
Field et al.

(10) Patent No.: US 7,968,266 B2
(45) **Date of Patent: *Jun. 28, 2011**

(54) TONER COMPOSITIONS

(75) Inventors: Lora Marie Field, Streetsville (CA); Valerie Farrugia, Oakville (CA); Ke Zhou, Mississauga (CA); Guerino G. Sacripante, Oakville (CA); Michael Hawkins, Cambridge (CA)

(73) Assignee: Xerox Corporation, Norwalk, CT (US)

( * ) Notice: Subject to any disclaimer, the term of this patent is extended or adjusted under 35 U.S.C. 154(b) by 961 days.

This patent is subject to a terminal disclaimer.

(21) Appl. No.: 11/557,359

(22) Filed: Nov. 7, 2006

(65) Prior Publication Data

US 2008/0107990 A1 May 8, 2008

(51) Int. Cl.
*G03G 9/087* (2006.01)

(52) U.S. Cl. ..... 430/109.3; 430/109.4; 430/137.16

(58) Field of Classification Search ..... 430/109.4, 430/109.3, 137.16

See application file for complete search history.

(56) References Cited

U.S. PATENT DOCUMENTS

| | | | | |
|---|---|---|---|---|
| 3,590,000 | A | 6/1971 | Palermiti et al. | |
| 3,800,588 | A | 4/1974 | Larson et al. | |
| 4,254,207 | A | 3/1981 | Landoll et al. | |
| 4,298,672 | A | 11/1981 | Lu | |
| 4,338,390 | A | 7/1982 | Lu | |
| 4,385,107 | A | 5/1983 | Tanaka et al. | |
| 4,952,477 | A | 8/1990 | Fuller et al. | |
| 4,990,424 | A | 2/1991 | Van Dusen et al. | |
| 5,166,026 | A | 11/1992 | Fuller et al. | |
| 5,278,020 | A | 1/1994 | Grushkin et al. | |
| 5,290,654 | A | 3/1994 | Sacripante et al. | |
| 5,302,486 | A | 4/1994 | Patel et al. | |
| 5,308,734 | A | 5/1994 | Sacripante et al. | |
| 5,344,738 | A | 9/1994 | Kmiecik-Lawrynowicz et al. | |
| 5,346,797 | A | 9/1994 | Kmiecik-Lawrynowicz et al. | |
| 5,364,729 | A | 11/1994 | Kmiecik-Lawrynowicz et al. | |
| 5,370,963 | A | 12/1994 | Patel et al. | |
| 5,403,693 | A | 4/1995 | Patel et al. | |
| 5,418,108 | A | 5/1995 | Kmiecik-Lawrynowicz et al. | |
| 5,686,218 | A | 11/1997 | Liebermann et al. | |
| 5,916,725 | A | 6/1999 | Patel et al. | |
| 6,214,507 | B1 | 4/2001 | Sokol et al. | |
| 6,383,705 | B2 | 5/2002 | Aoki et al. | |
| 6,830,860 | B2 | 12/2004 | Sacripante et al. | |
| 7,547,499 | B2 * | 6/2009 | Veregin et al. | 430/109.1 |
| 7,560,213 | B2 * | 7/2009 | Matsuoka et al. | 430/109.4 |
| 2004/0265721 | A1 * | 12/2004 | Matsuoka et al. | 430/109.4 |
| 2005/0227157 | A1 * | 10/2005 | Shirai | 430/106.1 |
| 2005/0227160 | A1 | 10/2005 | Shirai et al. | |
| 2005/0271965 | A1 | 12/2005 | Kamiyoshi et al. | |
| 2006/0216627 | A1 | 9/2006 | Mizutani et al. | |
| 2006/0223934 | A1 | 10/2006 | Chen et al. | |

FOREIGN PATENT DOCUMENTS

| | | |
|---|---|---|
| EP | 1 708 035 A1 | 10/2006 |
| JP | A-2004-226847 | 8/2004 |

OTHER PUBLICATIONS

Whelan, Tony, Consultant, Polymer Technology Dictionary, Chapman & Hall, London (1994), p. 12.*
U.S. Appl. No. 11/037,214, filed Jan. 19, 2005, to Patel et al.
U.S. Appl. No. 11/089,149, filed Mar. 25, 2005, to Sacripante et al.
U.S. Appl. No. 11/159,177, filed Jun. 23, 2005, to Veregin et al.
U.S. Appl. No. 11/169,757, filed Jun. 30, 2005, to Farrugia et al.
U.S. Appl. No. 11/464,367, filed Aug. 14, 2006, to Patel et al.
Mar. 11, 2010 European Search Report issued in EP 07 11 9946.
Jul. 23, 2010 Canadian Office Action issued in Canadian Patent Application No. 2,608,820.

* cited by examiner

*Primary Examiner* — Janis L Dote
(74) *Attorney, Agent, or Firm* — Oliff & Berridge, PLC

(57) ABSTRACT

Toner compositions comprising low-melt toner particles and methods of preparing such toner compositions are provided. The toner particles include a polyester-containing binder, a colorant and an optional wax. The binder includes at least one crystalline polyester resin and at one amorphous acidic polyester resin.

13 Claims, No Drawings

TONER COMPOSITIONS

TECHNICAL FIELD

This disclosure is generally directed to toner compositions and processes. More specifically, this disclosure is directed to toner compositions that comprise toner particles comprising: a binder, a colorant and optionally a wax; and the binder comprises a mixture of a crystalline polyester resin and an amorphous acidic polyester resin, and to processes, such as emulsion-aggregation processes, for preparing such toner particles, processes for preparing toner compositions comprising such toner particles, and processes for using such toner compositions.

RELATED APPLICATIONS

Commonly assigned, U.S. patent application Ser. No. 11/037,214 filed Jan. 19, 2005, to Patel et al., describes a toner comprising a toner binder comprised of crystalline sulfonated polyester, wherein the crystalline sulfonated polyester comprises 90% by weight or more of the toner binder, and a colorant.

Commonly assigned, U.S. patent application Ser. No. 11/08,149 filed Mar. 25, 2005, to Sacripante et al., describes a toner particle comprising a binder, wherein the binder comprises an amorphous resin and a crystalline resin, and wherein the crystalline resin has a melting point of at least about 70° C. and a recrystallization point of at least about 47° C.

Commonly assigned, U.S. patent application Ser. No. 11/159,177 filed Jun. 23, 2005, to Veregin et al., describes a toner comprising a crystalline polyester resin, an amorphous resin and a colorant, wherein the toner has a resistivity of at least about $1\times10^{11}$ ohm-cm.

Commonly assigned, U.S. patent application Ser. No. 11/169,757 filed Jun. 30, 2005, to Farrugia et al., describes toner particles comprising one or more unsaturated resin, optional colorants and optional waxes, wherein the unsaturated resin is reacted with a peroxy compound to form a cross-linked shell on at least a surface of the toner particles.

Commonly assigned, U.S. patent application Ser. No. 11/464,367 filed Aug. 14, 2006, to Patel et al., describes a toner composition comprising: a styrene-based polymer resin; a crystalline polyester wax, a second wax different from said crystalline polyester wax; a colorant; and a coagulant.

Appropriate components and process aspects of each of the foregoing, such as the toner compositions, resins included in the toner compositions and processes, may be selected for the present disclosure in embodiments thereof. The entire disclosures of the above-mentioned applications are total iv incorporated herein by reference.

REFERENCES

U.S. Pat. No. 5,916,725, the disclosure of which is incorporated herein by reference in its entirety, describes a process for preparing toner compositions comprising mixing an amine, an emulsion latex containing sulfonated-polyester resin, and a colorant dispersion, heating the resulting mixture, and optionally cooling.

Commonly owned U.S. Pat. No. 5,686,218 to Lieberman et al. describes a toner comprised of a polyester obtained by a process which comprises reacting a polyester resin endcapped with hydroxyl moieties or groups with an organic acid anhydride at a temperature of from about 125° C. to about 200° C., thereby resulting in a polyester resin endcapped with acidic moieties or acid groups, and pigment.

U.S. Pat. No. 5,593,807, the disclosure of which is incorporated herein by reference in its entirety, provides a process for preparing toner compositions comprising (i) preparing an emulsion latex comprised of sodio-sulfonated polyester resin particles of from about 5 to about 500 nanometers in size diameter by heating the resin in water at a temperature of from about 65° C. to about 90° C.; (ii) preparing a pigment dispersion in water by dispersing in water from about 10 to about 25 weight percent of sodio-sulfonated polyester and from about 1 to about 5 weight percent of pigment; (iii) adding the pigment dispersion to the latex mixture with shearing, followed by the addition of an alkali halide in water until aggregation results as indicated, for example, by an increase in the latex viscosity of from about 2 centipoises to about 100 centipoises; (iv) heating the resulting mixture at a temperature of from about 45° C. to about 55° C. to cause further aggregation and enabling coalescence to from toner particles of from about 4 to about 9 microns in volume average diameter and with a geometric distribution of less than about 1.3; and optionally (v) cooling the product mixture to about 25° C. and washing and drying the product. The sulfonated polyesters disclosed in the '807 patent may be selected for use in embodiments.

Emulsion/aggregation/coalescing processes for the preparation of toners are illustrated in a number of Xerox patents, the disclosures of which are totally incorporated herein by reference, such as U.S. Pat. Nos. 5,290,654, 5,278,020, 5,308,734, 5,346,797, 5,370,963, 5,344,738, 5,403,693, 5,418,108 and 5,364,729. Also of interest may be U.S. Pat. Nos. 6,830,860, 6,383,705 and 4,385,107, the disclosures of which are totally incorporated herein by reference.

The disclosures of each of the foregoing patents and publications, and the disclosures of any patents and publications cited below, are hereby totally incorporated by reference. The appropriate components and process aspects of the each of the cited patents and publications may also be selected for the present compositions and processes in embodiments thereof.

BACKGROUND

Xerographic toners of a resin, a pigment, and a charge control agent are known. Toners useful for xerographic applications should exhibit certain performances related to storage stability, and particle-size integrity; that is, the toner particles should remain intact and not agglomerate until fused on paper. The toner compositions also should not substantially agglomerate at temperatures below about 50° C. to about 55° C., because environmental conditions vary. The toner compositions should also display acceptable triboelectric properties that vary with the type of carrier or developer composition.

It is also desirable for xerographic toner compositions to have low-temperature fusing on paper. There is pressure to reduce the fusing or fixing temperatures of toners onto paper, for example, to temperatures of from about 90° to about 120° C., to lower power consumption and to allow extended fuser-system lifetimes. Non-contact fusers, which heat toner images on paper by radiant heat, usually are not in contact with the paper and the toner image. Contact fusers, on the other hand, are in contact with the paper and the toner image, and the toner compositions used with contact fusers should not substantially transfer onto the fuser roller.

Toner-fixing performance can be characterized as a function of temperature. The maximum temperature at which the toner does not adhere to the fuser roll is called the hot-offset temperature (HOT). When the fuser temperature exceeds the toner's HOT, some of the molten toner adheres to the fuser roll during fixing and is transferred to subsequent substrates containing developed images. This transfer may result in blurred images. This undesirable phenomenon is called hot offset or cold offset depending on whether the temperature is below the fixing temperature of the paper (cold offset), or above the fixing temperature of the toner (hot offset).

The minimum fixing temperature (MFT) of the toner, which is the minimum temperature at which acceptable adhesion of the toner to the support medium occurs, should be as high as possible, but is always less than the toner composition's HOT. The MFT is determined, for example, by a crease test. The difference between MFT and HOT is called the fusing latitude of the toner, i.e., the temperature difference between the fixing temperature and the temperature at which the toner offsets onto the fuser.

Additionally, small-sized toner particles, such as those having average particle sizes of from about 3 to about 12 microns, such as from about 5 to about 7 microns, are desired, especially for use in high-resolution xerographic engines. Small-sized toner particles can be economically prepared by chemical processes, which involve the direct conversion of emulsion-sized particles to toner composites by aggregation and coalescence, or by suspension, micro-suspension, or micro-encapsulation processes.

Low-temperature-fixing toners comprised of semi-crystalline resins are known. For example, U.S. Pat. No. 5,166,026 discloses semi-crystalline copolymer resin toners, with melting points of from about 30° C. to about 100° C., and containing functional groups comprising hydroxy, carboxy, amino, amido, ammonium or halo, and pigment particles. Similarly, U.S. Pat. No. 4,952,477 discloses toner compositions of semi-crystalline polyolefin resin particles, with melting points of from about 50° C. to about 100° C., and containing functional groups comprising hydroxy, carboxy, amino, amido, ammonium or halo, and pigment particles. Although, some of these toners may provide low contact fixing temperatures of about 93.3° C. to about 107.2° C., the resins are derived from components with melting characteristics of about 30° C. to about 50° C., and are not believed to exhibit higher, more desirable melting characteristics, such as about 55° C. to about 60° C.

Crystalline-based toners are disclosed, for example in U.S. Pat. No. 4,254,207. Low-temperature-fixing toners comprised of cross-linked crystalline resin and amorphous polyester resin are illustrated in U.S. Pat. No. 4,990,424, in which the toner powder is comprised, for example, of polymer particles of partially carboxylated crystalline polyester and partially carboxylated amorphous polyester that has been cross-linked together at elevated temperature with the aid of an epoxy resin and a cross-linking catalyst.

Conventional low-melt toner compositions, such as those described above, generally comprise from about 10 to about 35% of an unsaturated crystalline resin and from about 90 to about 65% of a branched, amorphous polyester resin. Such toner compositions meet the crease, gloss, latitude, and charging performance requirements of high-speed production printing. These toners also meet heat-cohesion requirements when less than 10% additives are present. Such toners are prepared by conventional melt-extrusion techniques. However, the crystalline components of such toners are very ductile and are difficult to reduce to small particles, such as particles having an average particle diameter of about 7 microns, in sufficiently high yields.

There is thus a need to provide low-melt toners that include crystalline and amorphous polyester resins, that may be provided as small particles in high yields, and that may be used at lower fusing temperatures that still provide excellent properties including excellent document offset and heat cohesion, for good image quality, particularly for color copies and prints. There is also a need to provide economical processes for preparing such low melt toners that allow for controlled particle growth and controlled morphology or shape, and provide high yields of small particles.

SUMMARY

The present disclosure addresses these and other needs, by providing toner compositions comprising low melt toner particles that include a binder containing at least one crystalline polyester resin and at least one amorphous acidic polyester resin that has terminal carboxylic acid groups. Methods of preparing such toner compositions are also provided.

Exemplary toner compositions include particles, wherein the toner particles comprise: a binder; a colorant; and optionally a wax; wherein the binder comprises a crystalline polyester resin and an amorphous acidic polyester resin. Such exemplary toner compositions may include: a toner composition comprising toner particles, wherein the toner particles comprise a binder, a colorant, and optionally a wax, wherein the binder comprises a crystalline polyester resin and an amorphous acidic polyester resin, and the amorphous acidic polyester resin is a polyester resin that comprises from about 0 to about 1 mol % of an alkyl sulfonated moiety; a toner composition comprising toner particles, wherein the toner particles comprise: a binder, a colorant, and optionally a wax, wherein the binder comprises a crystalline polyester resin and an amorphous acidic polyester resin, and the crystalline polyester resin is present in an amount of about 5 to about 35 wt %, relative to a total weight of the binder; a toner composition comprising toner particles, wherein the toner particles comprise: a binder, a colorant, and optionally a wax, wherein the binder comprises a crystalline polyester resin and an amorphous acidic polyester resin, and the amorphous acidic polyester resin is present in an amount of about 65 to about 80 wt %, relative to a total weight of the binder; a toner composition comprising toner particles, wherein the toner particles comprise: a binder, a colorant, and optionally a wax, wherein the binder comprises a crystalline polyester resin and an amorphous acidic polyester resin, and the amorphous acidic polyester resin has an acid number of from about 0.9 to about 30, such as from about 2.5 to about 17, or from about 7 to about 15; or a toner composition comprising toner particles, wherein the toner particles comprise: a binder, a colorant, and optionally a wax, wherein the binder comprises a crystalline polyester resin and an amorphous acidic polyester resin, and the crystalline polyester resin has an acid number of from about 1 to about 20.

Moreover, the toner compositions of embodiments may provide improved cohesion under conditions of high humidity, and are of small particle size, such as from about 5 to 7 microns in diameter, and provide with lower melt fusing properties.

Exemplary processes for preparing toner compositions include providing an amorphous polyester resin; acidifying end groups of the amorphous polyester resin to produce a amorphous acidic polyester resin that has a terminal pendant acid group; preparing toner particles including the amorphous acidic polyester resin; and preparing a toner composition including the toner particles; wherein the toner particles comprise the amorphous acidic polyester resin, at least one crystalline polyester resin, a colorant, and optionally a wax. In embodiments, providing the amorphous polyester resin may comprise preparing the branched polyester resin by polymerizing a glycol monomer; or providing the amorphous polyester resin may comprise preparing the branched polyester resin by polymerizing a glycol monomer in the presence of the branching agent. In embodiments, the crystalline polyester resin may be present in an amount of about 20 to about 35 wt %, relative to a total weight of the binder.

Exemplary processes for preparing toner compositions include providing a first emulsion that comprises particles of at least one crystalline polyester resin; providing a second emulsion that comprises particles of at least one amorphous acidic polyester resin that has a terminal pendant acid group; providing a third emulsion that comprises particles of at least one colorant; optionally providing a fourth emulsion that comprises particles of at least one wax; combining said first emulsion, said second emulsion, said third emulsion and said fourth emulsion; optionally homogenizing said combined emulsions; aggregating particles to form aggregated particles; coalescing the aggregated particles to form fused particles; and optionally removing the fused particles.

These and other features and advantages of various embodiments of materials, devices, systems and/or methods are described in or are apparent from, the following detailed description.

EMBODIMENTS

This disclosure is not limited to particular embodiments described herein, and some components and processes may be varied by one of skill, based on this disclosure. The terminology used herein is for the purpose of describing particular embodiments only, and is not intended to be limiting.

In this specification and the claims that follow, singular forms such as "a," "an," and "the" include plural forms unless the content clearly dictates otherwise. In addition, reference may be made to a number of terms that shall be defined as follows:

The term "organic molecule" refers, for example, to any molecule that is made up predominantly of carbon and hydrogen, such as, for example, alkanes and arylamines. The term "heteroatom" refers, for example, to any atom other than carbon and hydrogen. Typical heteroatoms included in organic molecules include oxygen, nitrogen, sulfur and the like.

The term "derivative" refers, for example, to compounds that are derived from another compound and maintain the same general structure as the compound from, which they are derived. For example, halogenated alkanes, saturated alcohols and saturated amines are derivatives of alkanes.

The term "functional group" refers, for example, to a group of atoms arranged in a way that determines the chemical properties of the group and the molecule to which it is attached. Derivative compounds may incorporate functional groups. Examples of functional groups include halogen atoms (—X), hydroxyl (—OH), carboxylic acid groups (—COOH), amine groups (—$NH_2$), nitro groups (—$NO_2$), and sulfonate groups (—$SO_4$). The term "sulfonated" refers, for example, to compounds that are derivatized by replacing a hydrogen atom with a sulfonate group. Functional groups on polymer chains are "pendant" from the polymer chain, and functional groups that are pendant from a chain terminus or end are "terminal" groups.

The term "alkane" refers, for example, to branched and unbranched molecules heaving; the general formula $C_nH_{2n+2}$, in which n is a number of 1 or more, such as of from about 1 to about 60. Exemplary alkanes include methane, ethane, n-propane, isopropane, n-butane, isobutane, tert-butane, octane, decane, tetradecane, hexadecane, eicosane, tetracosane and the like. Alkanes may be substituted by replacing hydrogen atoms with one or more functional groups to form alkane derivative compounds. For example, "halogenated alkanes" may be obtained by replacing one or more hydrogen atom with a halogen atom. The term "alkyl" refers, for example, to a branched or unbranched saturated hydrocarbon group, derived from an alkane and having the general formula $C_nH_{2+1}$, in which n is a number of 1 or more, such as of from about 1 to about 60.

"Alcohol" refers, for example, to an alkyl moiety in which one or more of the hydrogen atoms has been replaced by an —OH group. The term "lower alcohol" refers, for example, to an alkyl group of about 1 to about 6 carbon atoms in which at least one, and optionally all, of the hydrogen atoms has been replaced by an —OH group. The term "primary alcohol" refers, for example to alcohols in which the —OH group is bonded to a terminal or chain-ending carbon atom, such as in methanol, ethanol, 1-propanol, 1-butanol, 1-hexanol and the like. The term "secondary alcohol" refers, for example to alcohols in which the —OH group is bonded to a carbon atom that is bonded to one hydrogen atom and to two other carbon atoms, such as in 2-propanol (isopropanol), 2-butanol, 2-hexanol and the like. The term "tertiary alcohol" refers, for example to alcohols in which the —OH group is bonded to a carbon atom that is bonded to three other carbon atoms, such as in methylpropanol (tert-butanol) and the like.

"Amine" refers, for example, to an alkyl moiety in which one or more of the hydrogen atoms has been replaced by an —$NH_2$ group. The term "lower amine" refers, for example, to an alkyl group of about 1 to about 6 carbon atoms in which at least one, and optionally all, of the hydrogen atoms has been replaced by an —$NH_2$ group.

"Carbonyl compound" refers, for example, to an organic compound containing a carbonyl group, C═O, such as, for example, aldehydes, which have the general formula RCOH; ketones, which have the general formula RCOR'; carboxylic acids, which have the general formula RCOOH; and esters, which have the general formula RCOOR'.

The term "crystalline" refers herein to polymers having some degree of crystallinity and is intended to encompass both semicrystalline and fully crystalline polyester materials. The polyester is considered crystalline when it is comprised of crystals with a regular arrangement of its atoms in a space lattice. The term "amorphous" refers herein to polymers that are not crystalline.

The terms "standard temperature" and "standard pressure" refer, for example, to the standard conditions used as a basis where properties vary with temperature and/or pressure. Standard temperature is 0° C.; standard pressure is 101,325 Pa or 760.0 mmHg. The term "room temperature" refers, for example, to temperatures in a range of from about 20° C. to about 25° C.

The terms "high temperature environment" and "high temperature conditions" refer, for example, to an atmosphere in which the temperature is at least about 28 or about 30° C., and may be as high as about 300° C. The terms "high humidity environment" and "high humidity conditions" refer, for example, to an atmosphere in which the relative humidity is at least about 75 or about 80%.

"Optional" or "optionally" refer, for example, to instances in which subsequently described circumstance may or may not occur, and include instances in which the circumstance occurs and instances in which the circumstance does not occur.

The terms "one or more" and "at least one" refer, for example, to instances in which one of the subsequently described circumstances occurs, and to instances in which more than one of the subsequently described circumstances occurs. Similarly, the terms "two or more" and "at least two" refer, for example to instances in which two of the subsequently described circumstances occurs, and to instances in which more than two of the subsequently described circumstances occurs.

In embodiments, the toner compositions comprise toner particles including a binder, a colorant and optionally a wax. The binder of embodiments comprises at least one crystalline polyester resin and at least one amorphous acidic polyester resin, that has pendant carboxylic acid groups at or near the end of the polymer chain. In embodiments, the toner particles comprise from about 5 to about 20% by weight, with respect to the total weight of the toner particles, of the crystalline polyester resin, from about 50 to about 85% by weight, with respect to the total weight of the toner particles, of the amorphous acidic polyester resin, from about 3 to about 10% by weight, with respect to the total weight of the toner particles, of the colorant, and optionally from about 5 to about 10% by weight, with respect to the total weight of the toner particles, of a wax, to result in a toner with improved resistivity and cohesion properties.

While not wishing to be bound to any particular theory, it is believed that ionic moieties of both crystalline and amorphous resins, such as lithio sulfate ions, conduct charge. However, charge conduction is prevented under high relative humidity conditions due to water absorption. It is believed that reducing or eliminating the number of sulfonated groups in toner resins will improve charge conduction under high humidity conditions.

The amorphous acidic polyester resin of embodiments may be chosen from copolyacrylic-copolyester resins or from polyester resins that include acid groups, such as carboxylic acid groups, at or near the end of the polymer chain. Suitable amorphous acidic polyester resins comprise alkali sulfonated moieties (or are alkali sulfonated) in amounts of from 0 to about 1 mol %.

The addition of carboxylic acid moieties at ends of the amorphous acidic polyester resin chains assists in increasing the charge of the toner, and allows toner particles containing such amorphous acidic polyester resins to be prepared by chemical processes, such as emulsion-aggregation processes. In particular, carboxylic acid end groups can act as ionic groups to provide charge for the toner particles and toner compositions. The carboxylic acid group may also stabilize toner particles because it is known to be difficult to prepare toner particles from resins having low amounts of carboxylic acid groups and little or no sulfonation. Incorporating carboxylic acid groups at the ends of the polymer chains also allows improved flow or cohesion, even under conditions of high humidity.

One type of suitable amorphous acidic polyester resins for use in embodiments are copolyacrylic-copolyester resins. Such copolyacrylic-copolyester resins may be prepared by adding low molecular-weight polyacrylic acid, for example having a molecular weight of from about 500 to about 5000 grams/mole, to a polymerization reaction of a hydroxyl-terminated polyester resin. The low molecular-weight polyacrylic acid is added towards the end of polymerization to react with the hydroxyl end groups results in the formation of numerous carboxylic acid moieties per chain end, as shown in reaction scheme (A), below.

(A)

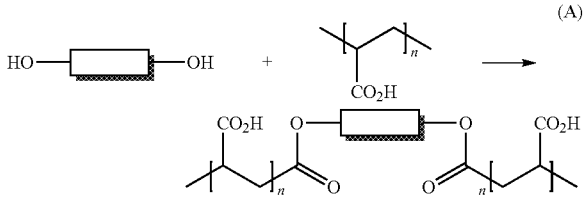

In embodiments, the hydroxyl-terminated polyester resin is first prepared by polycondensation. In particular, suitable organic diols are reacted with suitable organic diacids or diesters in the presence of a polycondensation catalyst. Generally, equimolar amounts of the organic diol and the organic diacid or diester are used in the reaction. However, when the boiling point of the organic diol is in a range of from about 180° C. to about 230° C., an excess amount of diol can be used and removed during the polycondensation process, followed by the addition of the polyacrylic acid at a temperature from about 160° C. to about 200° C. When organic diesters are used in place of organic diacids, an alcohol byproduct should be generated.

The hydroxyl-terminated amorphous polyester resins, in embodiments, may possess, for example, a number-average molecular weight (Mn), as measured by gel permeation chromatography (GPC), of from about 10,000 to about 500,000, such as from about 5,000 to about 250,000. The hydroxyl-terminated amorphous polyester resins may also possess a weight-average molecular weight (Mw) of, for example, from about 20,000 to about 600,000, such as from about 7,000 to about 300,000, as determined by GPC using polystyrene standards. In embodiments, the hydroxyl-terminated amorphous polyester resins may also possess a molecular-weight distribution (Mw/Mn) of, for example, from about 1.1 to about 6, such as from about 1.2 to about 4.

Examples of diacid or diesters selected for the preparation of amorphous polyesters include dicarboxylic acids or diesters selected from the group consisting of terephthalic acid, phthalic acid, isophthalic acid, fumaric acid, maleic acid, maleic anhydride, itaconic acid, succinic acid, succinic anhydride, dodecylsuccinic acid, dodecylsuccinic anhydride, glutaric acid, glutaric anhydride, adipic acid, pimelic acid, suberic acid, azelic acid, dodecanediacid, dimethyl terephthalate, diethyl terephthalate, dimethylisophtlhalate, diethylisophthalate, dimethylphthalate, phthalic anhydride, diethylphthalate, dimethylsuccinate, dimethylfumarate, dimethylmaleate, dimethylglutarate, dimethyladipate, dimethyl dodecylsuccinate, and mixtures thereof. In embodiments, organic diacid or diester may be used in amounts ranging from about 45 to about 52 mole % of the resin. Examples of diols utilized in generating amorphous polyesters include 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, bis(hydroxyethyl)-bisphenol A, bis(2-hydroxypropyl)-bisphenol A, 1,4-cyclohexanedimethanol, 1,3-cyclohexanedimethanol, xylenedimethanol, cyclohexanediol, diethylene glycol, bis(2-hydroxyethyl) oxide, dipropylene glycol, dibutylene, and mixtures thereof. The amount of organic diol selected can vary, for example, from about 45 to about 52 mole % of the resin. The sulfonated diacid monomer may be selected as an alkali sulfo-organic diacid such as the sodio, lithio or potassio salt of dimethyl-5-sulfo-isophthalate, dialkyl-5-sulfo-isophthalate-4-sulfo-1, 8-naphthalic anhydride, 4-sulfo-phthalic acid, dimethyl-4-sulfo-phthalate, dialkyl-4-sulfo-phthalate, 4-sulfophenyl-3,5-dicarbomethoxybenzene, 6-sulfo-2-naphthyl-3,5-dicarbomethoxybenzene, sulfo-terephthalic acid, dimethyl-sulfo-terephthalate, 5-sulfo-isophthalic acid, dialkyl-sulfo-terephthalate, sulfoethanediol, 2-sulfopropanediol, 2-sulfobutanediol, 3-sulfopentanediol, 2-sulfohexanediol, 3-sulfo-2-methylpentanediol, 2-sulfo-3,3-dimethylpentanediol, sulfo-p-hydroxybenzoic acid, and may be present in an amount of from 0 to about 1 mole % of the resin.

The polyacrylic acid utilized to form the amorphous acidic polyester resins may be any low molecular-weight polyacrylic acid that has an average molecular weight of from about 500 to about 10,000 grams/mole. The low molecular-weight polyacrylic acid is added to the hydroxyl-terminated polyester resin at the end of its preparation, at a temperature of from about 165 to about 200° C. Low molecular-weight polymethacrylic acids having an average molecular weight of from about 500 to about 10,000 grams/mole, may also be used in embodiments.

Polycondensation catalysts that may be used to produce amorphous acidic polyester resins include, for example, tetraalkyl titanates, dialkyltin oxide such as dibutyltin oxide; tetraalkyltins, such as dibutyltin dilaurate; dialkyltin oxide hydroxides, such as butyltin oxide hydroxide; aluminum alkoxides; alkyl zinc; dialkyl zinc; zinc oxide; stannous oxide; and mixtures thereof. Such polycondensation catalysts may be selected in amounts of, for example, from about 0.01 to about 5 mole %, or from about 0.01 to about 1 mole %, based on the starting diacid or diester used to generate the polyester resin.

In embodiments, the number of carboxylic acid end groups may be increased by increasing the amount of branching agent, such as those described above, used in preparing the polyester resins. By adding more branching agent to the polymerization reaction, highly branched polyester resins may be prepared having numerous ends per chain. The increased number of carboxylic acid end groups will result in a larger acid number for the resin.

Branching agents that may be used in embodiments include, for example, multivalent polyacids, such as 1,2,4-benzene-tricarboxylic acid, 1,2,4-cyclohexanetricarboxylic acid, 2,5,7-naphthalenetricarboxylic acid, 1,2,4-naphthalenetricarboxylic acid, 1,2,5-hexanetricarboxylic acid, 1,3-dicarboxyl-2-methyl-2-methylene-carboxylpropane, tetra(methylene-carboxyl)methane, and 1,2,7,8-octanetetracarboxylic acid; acid anhydrides of multivalent polyacids; and lower alkyl esters of multivalent polyacids; multivalent polyols, such as sorbitol, 1,2,3,6-hexanetetrol, 1,4-sorbitane, pentaerythritol, dipentaerythirtol, tripentaerythritol, sucrose, 1,2,4-butanetriol, 1,2,5-pentatriol, glycerol, 2-methylpropanetriol, 2-methyl-1,2,4-butanetriol, trimethylolethane, trimethylolpropane, 1,3,5-trihydroxymethylbenzene, mixtures thereof, and the like. The branching agent amount selected may be, for example, from about 0.1 to about 5 mole % of the resin.

Other suitable amorphous polyester resins that may be used in embodiments include linear and branched amorphous polyester resins, such as exemplary resin (B) below.

(B)

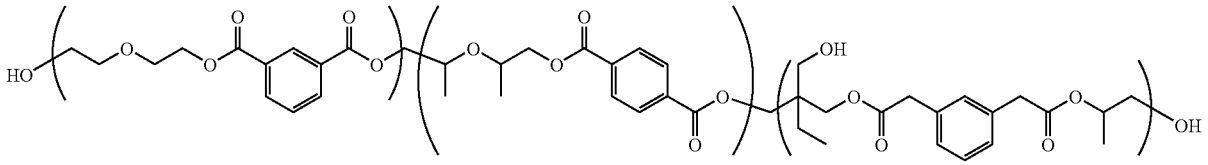

Linear and branched amorphous polyester resins, in embodiments, possess, for example, a number-average molecular weight (Mn), as measured by GPC, of from about 10,000 to about 500,000 and, in embodiments, from about 5,000 to about 250,000; a weight-average molecular weight (Mw) of, for example, from about 20,000 to about 600,000, and, in embodiments, from about 7,000 to about 300,000, as determined by GPC using polystyrene standards; and a molecular-weight distribution (Mw/Mn) of, for example, from about 1.1 to about 6, and, in embodiments, from about 1.2 to about 4.

The crystalline polyester resin of embodiments may be suitable unsaturated crystalline polyester resin, including any of the various crystalline polyesters, such as poly(ethylene-adipate), poly(propylene-adipate), poly(butylene-adipate), poly(pentylene-adipate), poly(hexylene-adipate), poly(octylene-adipate), poly(ethylene-succinate), poly(propylene-succinate), poly(butylene-succinate), poly(pentylene-succinate), poly(hexylene-succinate), poly(octylene-succinate), poly(ethylene-sebacate), poly(propylene-sebacate), poly(butylene-sebacate), poly(pentylene-sebacate), poly(hexylene-sebacate), poly(octylene-sebacate), copoly(5-sulfoisophthaloyl)-copoly(ethylene-adipate), copoly(5-sulfoisophthaloyl)-copoly(propylene-adipate), copoly(5-sulfo-isophthaloyl)-copoly(butylene-adipate), copoly(5-sulfo-isophthaloyl)-copoly(pentylene-adipate), copoly(5-sulfo-isophthaloyl)-copoly(hexylene-adipate), copoly(5-sulfo-isophthaloyl)-copoly(octylene-adipate), copoly(5-sulfo-isophthaloyl)-copoly(ethylene-adipate), copoly(5-sulfo-isophthaloyl)-copoly(propylene-adipate), copoly(5-sulfo-isophthaloyl)-copoly(butylene-adipate), copoly(5-sulfo-isophthaloyl)-copoly(pentylene-adipate), copoly(5-sulfo-isophthaloyl)-copoly(hexylene-adipate), copoly(5-sulfo-isophthaloyl)-copoly(octylene-adipate), copoly(5-sulfoisophthaloyl)-copoly(ethylene-succinate), copoly(5-sulfoisophthaloyl)-copoly(propylene-succinate), copoly(5-sulfoisophthaloyl)-copoly butylene-succinate), copoly(5-sulfoisophthaloyl)-copoly(pentylene-succinate), copoly(5-sulfoisophthaloyl)-copoly(hexylene-succinate), copoly(5-sulfoisophthaloyl)-copoly(octylene-succinate), copoly(5-sulfo-isophthaloyl)-copoly(ethylene-sebacate), copoly(5-sulfo-isophthaloyl)-copoly(propylene-sebacate), copoly(5-sulfo-isophthaloyl)-copoly(butylenes-sebacate), copoly(5-sulfo-isophthaloyl)-copoly(pentylene-sebacate), copoly(5-sulfo-isophthaloyl)-copoly(hexylene-sebacate), copoly(5-sulfo-isophthaloyl)-copoly(octylene-sebacate), copoly(5-sulfo-isophthaloyl)-copoly(ethylene-adipate), copoly(5-sulfo-isophthaloyl)-copoly(propylene-adipate) copoly(5-sulfo-isophthaloyl)-copoly(butylene-adipate), copoly(5-sulfo-isophthaloyl)-copoly(pentylene-adipate), copoly(5-sulfo-isophthaloyl)-copoly(hexylene-adipate), or unsaturated copolyesters such as copoly(ethylene-fumarate)-copoly(ethylene-sebacate), copoly(ethylene-fumarate)-copoly(ethylene-adipate), copoly(ethylene-fumarate)-copoly (ethylene-dodecanaote), copoly(butylene-fumarate)-copoly (ethylene-sebacate), copoly(butylene-fumarate)-copoly (hexylene-fumarate), mixture thereof and the like. For example, exemplary resin (C) below may be suitable as the crystalline polyester resin of some embodiments.

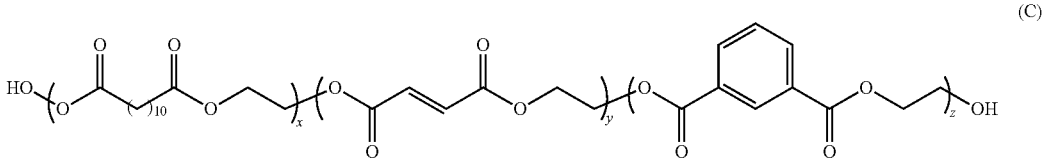

(C)

The crystalline polyester resin of embodiments may be obtained from numerous sources and can possess various melting points of, for example, from about 30° C. to about 120° C., and, in embodiments, from about 50° C. to about 90° C. The crystalline polyester resin may have, for example, a number-average molecular weight (Mn), as measured by GPC of, for example, from about 1,000 to about 50,000, and, in embodiments, from about 2,000 to about 25,000. The weight-average molecular weight (Mw) of the crystalline polyester resin may be, for example, from about 2,000 to about 100,000, and, in embodiments, from about 3,000 to about 80,000, as determined by GPC using polystyrene standards. The molecular weight distribution (Mw/Mn) of the crystalline polyester resin is, for example, from about 2 to about 6, and, in embodiments, from about 2 to about 4.

The crystalline polyester resins can be prepared by the polycondensation process of reacting suitable organic diols with suitable organic diacids or diesters, in the presence of a polycondensation catalyst. Generally, a stoichiometric equimolar ratio of organic diol and organic diacid is utilized, however, in some instances, wherein the boiling point of the organic diol is from about 180° C. to about 230° C., an excess amount of diol can be utilized and removed during the polycondensation process. The amount of catalyst utilized varies, and can be selected in an amount, for example, of from about 0.01 to about 1 mole % of the resin. When organic diesters are used in place of organic diacids, an alcohol byproduct should be generated.

Examples of organic diols include aliphatic diols with from about 2 to about 36 carbon atoms, such as 1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol and the like; mixtures thereof, and the like. The aliphatic diol may be, for example, selected in an amount of from about 45 to about 50 mole % of the resin.

Examples of organic diacids or diesters selected for preparing of the crystalline resins include oxalic acid, succinic acid, glutaric acid, adipic acid, suberic acid, azelaic acid, sebacic acid, phthalic acid, isophthalic acid, terephthalic acid, napthalene-2,6-dicarboxylic acid, naphthalene-2,7-dicarboxylic acid, cyclohexane dicarboxylic acid, malonic acid, fumaric acid, maleic acid, maleic anhydride, and mesaconic acid, a diester or anhydride, thereof; and mixtures thereof. The organic diacid is selected in an amount of, for example, from about 40 to about 50 mole % of the resin.

The branching agents and polycondensation catalysts that may be used in the preparation of amorphous polyesters may likewise be used in the preparation of crystalline polyesters of embodiments. Such branching agents may be used in amounts of for example, from about 0.1 to about 5 mole % of the resin, and such polycondensation catalysts may be used in amounts of, for example, from about 0.01 to about 5 mole % based on the starting diacid or diester used to generate the polyester resin.

Carboxylic acid groups can be incorporated into the polyester resins by any known or later developed methods. For example, one technique that can be used to modify the end groups of the resin is to add an acid anhydride, which results in acidic end groups.

Another technique for incorporating carboxylic acid end groups into the polyester resins involves adding an anhydride, such as trimellitic anhydride, towards the end of polymerization. Normally, excess glycol is used in the polymerization of the resins, resulting in a polymer chain having hydroxyl end groups. Adding trimellitic anhydride (TMA) towards the end of the polymerization to react with the hydroxyl end groups results in the formation of two carboxylic acid moieties per chain end, as shown in reaction scheme (D), below.

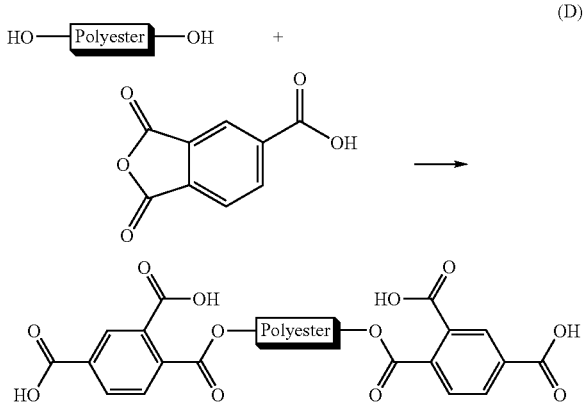

(D)

By varying the mol percent of sulfonation of the resins, the amount of TMA, and the amount of branching, a wide variety of exemplary amorphous and crystalline resins having carboxylic acid containing end groups can be prepared, as shown in Table 1. In Table 1, BSPE refers to branched sulfonated amorphous polyester resin, BPE refers to branched amorphous polyester resin, LPE refers to linear amorphous polyester resin, CPE refers to crystalline polyester resin, Tg refers to the glass transition temperature of the resin, Ts refers to the softening point of the resin, $Tm_1$ refers to melting point of the resin, and Tc refers to the crystallization temperature of the resin.

TABLE 1

| Resin Type | Mol % Sulfo-nation | TMA wt % | Tg (° C.) | Ts (° C.) | Viscosity (at 85° C.) | Tm (° C.) | Tc (° C.) | Acid number |
|---|---|---|---|---|---|---|---|---|
| BSPE | 1 | 0 | 58.0 | 135.5 | — | — | — | 1.62 |
| BSPE | 1 | 1.24 | 55.8 | 129.2 | — | — | — | 6.93 |
| BSPE | 0.5 | 1.5 | 61.6 | 138.3 | — | — | — | 8.85 |
| BPE | 0 | 0 | 57.4 | 141.2 | — | — | — | 0.90 |
| BPE | 0 | 0.31 | 54.5 | 133.5 | — | — | — | 2.41 |
| BPE | 0 | 1.5 | 58.0 | 137.2 | — | — | — | 13.29 |
| BPE | 0 | 2.0 | 56.3 | 135.5 | — | — | — | 15.07 |
| BPE | 0 | 2.5 | 50.0 | 121.4 | — | — | — | |
| LPE | 0 | 2.5 | 58.8 | 118.7 | — | — | — | 17.82 |
| CPE | 1 | 0 | — | — | 166 | 82.1 | 52.5 | 1.43 |
| CPE | 1 | 0.34 | — | — | 174 | 78.5 | 51.7 | 2.19 |
| CPE | 1 | 2.63 | — | — | 90 | 75.7 | 43.6 | 9.87 |
| CPE | 0 | 0 | — | — | 104 | 84.1 | 56.7 | 1.59 |
| CPE | 0 | 0.34 | — | — | 113 | 83.6 | 58.2 | 2.38 |
| CPE | 0 | 1.5 | — | — | 87 | 78.8 | 53.7 | 13.97 |

The acid number is related to how many carboxylic acid end groups are in the polymer. The amount of carboxylic acid functionality was primarily determined by measuring the acid number.

Another technique for incorporating carboxylic acid end groups into the polyester resins involves adding low molecular weight polyacrylic acid, for example having a molecular weight of from about 500 to about 10,000 grams/mole towards the end of polymerization. Adding a low molecular weight polyacrylic acid towards the end of the polymerization to react with the hydroxyl end groups results in the formation of numerous carboxylic acid moieties per chain end, as shown in reaction scheme (A), above.

However, resins resulting from this process, in embodiments, may have low solubility in common organic solvents.

In addition, the number of carboxylic acid end groups may be increased by increasing the amount of branching agent, such as those described above, used in preparing the polyester resins. By adding more branching agent to the polymerization reaction, highly branched polyester resins may be prepared having numerous ends per chain. The increased number of carboxylic acid end groups will result in a larger acid number for the resin.

In addition, the number of carboxylic acid end groups may be increased by increasing the amount of branching agent, such as those described above, used in preparing the polyester resins. By adding more branching agent to the polymerization reaction, highly branched polyester resins may be prepared having numerous ends per chain. The increased number of carboxylic acid end groups will result in a larger acid number for the resin.

The toner particles may be prepared by a variety of known methods. Although embodiments relating to toner particle production are described below with respect to emulsion-aggregation processes, any suitable method of preparing toner particles may be used, including chemical processes, such as the suspension and encapsulation processes disclosed in U.S. Pat. Nos. 5,290,654 and 5,302,486, the disclosures of which are incorporated herein in their entirety. In embodiments, toner compositions and toner particles are prepared by well-known aggregation and coalescence processes in which small-size resin particles are aggregated to the appropriate toner particle size and then coalesced to achieve the final toner-particle shape and morphology.

In embodiments, toner compositions may be prepared by any of the known emulsion-aggregation processes, such as a process that includes aggregating a mixture of an optional colorant, an optional wax and any other desired or required additives, and emulsions comprising the binder resins, and then coalescing the aggregate mixture. The resin emulsion may be prepared by dissolving resin in a suitable solvent. Polyester emulsions, including any emulsions that contain crystalline polyester resin and/or amorphous acidic polyester resin, may be similarly prepared. Suitable solvents include alcohols, ketones, esters, ethers, chlorinated solvents, nitrogen containing solvents and mixtures thereof. Specific examples of suitable solvents include acetone, methyl acetate, methyl ethyl ketone, tetrahydrofuran, cyclohexanone, ethyl acetate, N,N dimethylformamide, dioctyl phthalate, toluene, xylene, benzene, dimethylsulfoxide, mixtures thereof, and the like. Particular solvents that can be used include acetone, methyl ethyl ketone, cyclohexanone, methyl acetate, ethyl acetate, dimethylsulfoxide, and mixtures thereof if desired or necessary, the resin can be dissolved in the solvent at elevated temperature, such as about 40 to about 80° C. or about 50 to about 70° or about 60 to about 65° C., although the temperature is desirable lower than the glass transition temperature of the wax and resin. In embodiments, the resin is dissolved in the solvent at elevated temperature but below the boiling point of the solvent, such as at about 2 to about 15° C. or about 5 to about 10° C. below the boiling point of the solvent.

The resin is dissolved in the solvent, and is mixed into an emulsion medium, for example water such as deionized water containing a stabilizer, and optionally a surfactant. Examples of suitable stabilizers include water-soluble alkali metal hydroxides, such as sodium hydroxide, potassium hydroxide, lithium hydroxide, beryllium hydroxide, magnesium hydroxide, calcium hydroxide, or barium hydroxide; ammonium hydroxide; alkali metal carbonates, such as sodium bicarbonate, lithium bicarbonate, potassium bicarbonate, lithium carbonate, potassium carbonate, sodium carbonate, beryllium carbonate, magnesium carbonate, calcium carbonate, barium carbonate or cesium carbonate; or mixtures thereof. In embodiments, a particularly desirable stabilizer is sodium bicarbonate or ammonium hydroxide. When the stabilizer is used in the composition, it is typically present in amounts of from about 0.1 to about 5%, such as about 0.5 to about 3%, by weight of the wax and resin. When such salts are added to the composition as a stabilizer, it is desired in embodiments that incompatible metal salts are not resent in the composition. For example, when these salts are used, the composition should be completely or essentially free of zinc and other incompatible metal ions, e.g., Ca, Fe, Ba, etc. that form water-insoluble salts. The term "essentially free" refers, for example, to the incompatible metal ions as present at a level of less than about 0.01%, such as less than about 0.005%) or less than about 0.001%, by weight of the wax and resin. If desired or necessary the stabilizer can be added to the mixture at ambient temperature, or it can be heated to the mixture temperature prior to addition.

Optionally, it may be desirable to add an additional stabilizer such as a surfactant to the aqueous emulsion medium such as to afford additional stabilization to the resin. Suitable surfactants include anionic, cationic and nonionic surfactants. In embodiments, the use of anionic and nonionic surfactants can additionally help stabilize the aggregation process in the presence of the coagulant, which otherwise could lead to aggregation instability.

Anionic surfactants include sodium dodecylsulfate (SDS), sodium dodecyl benzene sulfonate, sodium dodecylnaphthalene sulfate, dialkyl benzenealkyl, sulfates and sulfonates, abitic acid, and the NEOGEN brand of anionic surfactants. An example of a suitable anionic surfactant is NEOGEN R-K available from Daiichi Kogyo Seiyaku Co, Ltd. (Japan), or TAYCAPOWER BN2060 from Tayca Corporation (Japan), which consists primarily of branched sodium dodecyl benzene sulfonate.

Examples of cationic surfactants include dialkyl benzene alkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecyl benzyl triethyl ammonium chloride, MIRAPOL and ALKAQUAT available from Alkaril Chemical Company, SANISOL, (benzalkonium chloride), available from Kao Chemicals, and the like. An example of a suitable cationic surfactant is SANISOL B-50 available from Kao Corporation, which consists primarily of benzyl dimethyl alkonium chloride.

Examples of nonionic surfactants include polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethlylene nonylphenyl ether, dialkylphenoxy poly(ethyleneoxy) ethanol, available from Rhone-Poulenc Inc, as IGEPAL CA-210, IGEPAL CA-520, IGEPAL CA-720, IGEPAL CO-890, IGEPAL CO-720, IGEPAL CO-290, IGEPAL CA-210, ANTAROX 890 and ANTAROX 897. An example of a suitable nonionic surfactant is ANTAROX 897 available from Rhone-Poulenc Inc., which consists primarily of alkyl phenol ethoxylate.

After the stabilizer or stabilizers are added, the resultant mixture can be mixed or homogenized for any desired time.

Next, the mixture is heated to flash off the solvent, and then cooled to room temperature. For example, the solvent flashing can be conducted at any suitable temperature above the boiling point of the solvent in water that will flash off the solvent, such as about 60 to about 100° C., for example about 70 to about 90° C. or about 80° C., although the temperature may be adjusted based on, for example, the particular wax, resin, and solvent used.

Following the solvent flash step, the polyester resin emulsion, in embodiments have an average particle diameter in the range of about 100 to about 500 nanometers, such as from about 130 to about 300 nanometers as measured with a Honeywell MICROTRAC® UPA150 particle size analyzer.

A pre-toner mixture is prepared by combining the colorant, and optionally a wax or other materials, surfactant, and both the crystalline and amorphous acidic polyester emulsions, which may be two or more emulsions that contain either the crystalline polyester resin or the amorphous acidic polyester resin. In embodiments, the pH of the pre-toner mixture is adjusted to between about 2.5 to about 4. The pH of the pre-toner mixture may be adjusted by an acid such as, for example, acetic acid, nitric acid or the like. Additionally, in embodiments, the pre-toner mixture optionally may be homogenized. If the pre-toner mixture is homogenized, homogenization may be accomplished by mixing at about 600 to about 4,000 revolutions per minute. Homogenization may be accomplished by any suitable means, including, for example, an IKA ULTRA TURRAX T50 probe homogenizer.

Following the preparation of the pre-toner mixture, an aggregate mixture is formed by adding an aggregating agent (coagulant) to the pre-toner mixture. The aggregating agent is generally an aqueous solution of a divalent cation or a multivalent cation material. The aggregating agent may be, for example, polyaluminum halides such as polyaluminum chloride (PAC), or the corresponding bromide, fluoride, or iodide, polyaluminum silicates such as polyaluminum sulfosilicate (PASS), and water soluble metal salts including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, zinc chloride, zinc bromide, magnesium bromide, copper chloride, copper sulfate, and combinations thereof. In embodiments, the aggregating agent may be added to the pre-toner mixture at a temperature that is below the glass transition temperature ($T_g$) of the emulsion resin. In some embodiments, the aggregating agent may be added in an amount of about 0.05 to about 3.0 pph and from about 1.0 to about 10 pph with respect to the weight of toner. The aggregating agent may be added to the pre-toner mixture over a period of from about 0 to about 60 minutes. Aggregation may be accomplished with or without maintaining homogenization. Aggregation is accomplished at temperatures that are preferably greater then 60° C.

In embodiments, although either a multivalent salt, such as polyaluminum chloride, or a divalent salt, such as zinc acetate, may be used, and the toner formulations may be identical for both aggregating agents, the process of preparing the toner particles is different. A divalent cation material is used in embodiments in which the binder includes both linear amorphous and crystalline polyesters. In the case of the multivalent salt, anion and nonionic surfactants can be added to the latex mixture to stabilize the particle and reduce the shocking when a multivalent aggregating agent like PAC is added. PAC is also required to be added at room temperature (cold addition) to initiate aggregation in the presence of the pigment, since the addition of PAC at elevated temperature is typically not effective. In embodiments in which divalent salts are used as aggregating agents, the agent may be added at elevated temperature, for example about 50 to 60° C. (hot addition) as opposed to cold addition. The primarily reason for this is that zinc acetate dissociates itself into the aqueous phase and the particle (pKa of zinc acetate is about 4.6). The dissociation is temperature dependent as well as pH dependent. When zinc acetate is added at elevated temperature, the temperature factor is minimized or eliminated. The amount of zinc acetate added can controlled to control the particle size, while in the case of cold addition of zinc acetate, neither of these parameters can be controlled.

Thus, the process calls for blending the crystalline polyester resin and the linear and/or branched amorphous polyester resin emulsions, together in the presence of a pigment and optionally a wax or other additives, all comprising submicron particles, heating the blend from room temperature to about 60° C., followed by addition of addition of zinc acetate solution. The temperature may be slowly raised to 65° C. and held there for about 6 hours to provide 9 micron particles the have a shape factor of, for example, about 115 to about 130 as measured on the FPIA SYSMEX analyzer.

When a multivalent ion like PAC is used as the aggregating agent, it must be added cold as discussed above. Thus, the process steps are different than with zinc acetate, and calls for the addition of surfactants to the latex blend, followed by the addition of the pigment and optional additives. The surfactant stabilizes the particles by either electrostatic or steric forces or both, to prevent massive flocculation, when the aggregating agent is added. The pH of the blend containing the blend of toners, pigment, optional additives (wax), etc. is adjusted from about 5.6 to about 3.0 with 0.1 M nitric acid, followed by the addition of PAC, while being polytroned at speeds of about 5000 rpm. The temperature of the mixture is raised from room temperature to 55° C., and slowly in stages to about 70° C. in order to coalesce the particles. No pH adjustment is required to stabilize the particle size in either of the two aggregating agent processes.

Following aggregation, the aggregates are coalesced. Coalescence may be accomplished by heating the aggregate mixture to a temperature that is about 5 to about 20° C. above the $T_g$ of the emulsion resin. Generally, the aggregated mixture is heated to a temperature of about 50 to about 80° C. In embodiments, the mixture may also be stirred at from about 200 to about 750 revolutions per minute to coalesce the particles. Coalescence may be accomplished over a period of from about 3 to about 9 hours.

Optionally, during coalescence, the particle size of the toner particles may be controlled and adjusted to a desired size by adjusting the pH of the mixture. Generally, to control the particle size, the pH of the mixture is adjusted to between about 5 to about 7 using a base such as, for example, sodium hydroxide.

After coalescence, the mixture may be cooled to room temperature. After cooling, the mixture of toner particles of some embodiments may be washed with water and then dried. Drying may be accomplished by any suitable method for drying including freeze drying. Freeze drying is typically accomplished at temperatures of about −80° C. for a period of about 72 hours.

Upon aggregation and coalescence, the toner particles of embodiments have an average particle size of from about 1 to about 15 microns, in further embodiments of from about 4 to about 15 microns, and, in particular embodiments, of from about 6 to about 11 microns, such as 7 microns. The geometric size distribution (GSD) of the toner particles of embodiments may be in a range of from about 1.20 to about 1.35, and in particular embodiments of less than about 1.25.

In embodiments, the process may include the use of surfactants, emulsifiers, and other additives such as those discussed above. Likewise, various modifications of the above process will be apparent and are encompassed herein.

In embodiments, additives may be included in the toner compositions. Appropriate additives for inclusion in embodiments include, for example, colorants; magnetites; flocculates; curing agents; waxes; charge additives; flow-promoting agents; flow-control agents; plasticizers; stabilizers; anti-gassing and degassing agents; leveling agents; surface additives; antioxidants; UV absorbers; light stabilizers; fillers and mixtures thereof. In embodiments, additives may be incorporated into the toner particles during toner particle preparation or after cross-linking, as surface additives. Any suitable method of incorporating additives, either during toner preparation or after surface cross-linking, as surface additives, may be used.

Toner compositions of embodiments may include one or more colorant. Various known suitable colorants include dyes, pigments, mixtures thereof, such as mixtures of dyes, mixtures of pigments and mixtures of dyes and pigments, and the like. Colorants may be included in the toner in an effective amount of, for example, about 1 to about 25 weight % of the toner, and in embodiments, in an amount of about 1 to about 15 weight %.

As examples of suitable colorants, which is not intended to be an exhaustive list, mention may be made of carbon black like REGAL 330®; magnetites, such as MOBAY magnetites M08029™, MO8060™; COLUMBIAN magnetites; MAPICO BLACKS™ and surface treated magnetites; Pfizer magnetites CB4799™, CB5300 ™, CB5600™, MCX6369™; Bayer magnetites, BAYFERROX 8600™, 8610™; NORTHERN PIGMENTS magnetites, NP-604™, NP-608™; MAGNOX magnetites TMB-100™, or TMB-104™; and the like. As colored pigments, there can be selected cyan, magenta, yellow, red, green, brown, blue or mixtures thereof. Specific examples of pigments include phthalocyanine HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E.I. DuPont de Nemours & Company, and the like.

Generally, colorants that can be selected are black, cyan, magenta, or yellow, and mixtures thereof. Examples of magentas are 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyans include copper tetra(octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-21337, and the like. Illustrative examples of yellows are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as FORON Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK™, and cyan components may also be selected as colorants.

Other known colorants can be selected such as LEVANYL Black A-SF (Miles, Bayer) and SUNSPERSE Carbon Black LHD 9303 (Sun Chemicals), and colored dyes such as NEOPEN Blue (BASF), SUDAN Blue OS (BASF), PV Fast Blue B2G01 (American Hoechst), SUNSPERSE Blue BHD 6000 (Sun Chemicals), IRGALITE Blue BCA (Ciba-Geigy), PALIOGEN Blue 6470 (BASF), SUDAN III (Matheson, Coleman, Bell), SUDAN II (Matheson, Coleman, Bell), SUDAN IV (Matheson, Coleman, Bell), SUDAN Orange G (Aldrich), SUDAN Orange 220 (BASF), PALIOGEN Orange 3040 (BASF), ORTHO Orange OR 2673 (Paul Uhlich), PALIOGEN Yellow 152, 1560 (BASF), LITHOL Fast Yellow 0991K (BASF), PALIOTOL Yellow 1840 (BASF), NEOPEN Yellow (BASF), Permanent Yellow YE 0305 (Paul Uhlich), LUMOGEN Yellow D0790 (BASF), SUNSPERSE Yellow YHD 6001 (Sun Chemicals), SUCO-GELB L1250 (BASF), SUCO-YELLOW D1355 (BASF), FANAL Pink D4830 (BASF), CINQUASIA Magenta (DuPont), LITHOL Scarlet D3700 (BASF), Scarlet for THERMOPLAST NSD PS PA (Ugine Kuhlmann of Canada), LITHOL Rubine Toner (Paul Uhlich), LITHOL Scarlet 4440 (BASF), Royal Brilliant Red RD-8192 (Paul Uhlich), ORACET Pink RF (Ciba-Geigy), PALIOGEN Red 3871K (BASF), PALIOGEN Red 3340 (BASF), and LITHOL Fast Scarlet L4300 (BASF).

Optionally, the toner compositions may also include a wax. When included, the wax may be present in an amount of from about, for example, 1 to about 25 weight %, and, in certain embodiments, from about 5 to about 20 weight %, of the toner. Examples of suitable waxes include, but are not limited to polypropylenes and polyethylenes commercially available from Allied Chemical and Petrolite Corporation (e.g., POLYWAX™ polyethylene waxes from Baker Petrolite); wax emulsions available from Michaelman, Inc. and the Daniels Products Company, EPOLENE N-15™ commercially available from Eastman Chemical Products, Inc., VISCOL 550-P™; low weight-average molecular-weight polypropylenes available from Sanyo Kasei K. K., CARNUBA Wax and similar materials. Examples of functionalized waxes include, for example, amines; amides, for example AQUA SUPERSLIP 6550™, SUPERSLIP 6530™ available from Micro Powder Inc.; fluorinated waxes, for example POLYFLUO 190™, POLYFLUO 200™, POLYSILK 19™, POLYSILK 14™ available from Micro Powder Inc.; mixed fluorinated amide waxes, for example MICROSPERSION 19™ also available from Micro Powder Inc.; imides; esters; quaternary amines; carboxylic acids or acrylic polymer emulsions, for example JONCRYL 74™, 89™, 130™, 537™, and 538™, all available from SC Johnson Wax; and chlorinated polypropylenes and polyethylenes available from Allied Chemical and Petrolite Corporation and SC Johnson Wax.

The toners of embodiments may also contain other optional additives, as desired or required. For example, the toner may include positive or negative charge enhancing additives, in embodiments in amounts of from about 0.1 to about 10 weight %, or from about 1 to about 3 weight %, of the toner. Examples of these additives include quaternary ammonium compounds inclusive of alkyl pyridinium halides; alkyl pyridinium compounds such as those described in U.S. Pat. No. 4,298,672, the disclosure of which is incorporated herein by reference; organic sulfate and sulfonate compositions such as those described in U.S. Pat. No. 4,338,390, the disclosure of which is incorporated herein by reference; cetyl pyridinium tetrafluoroborates; distearyl dimethyl ammonium methyl sulfate; aluminum salts such as BONTRON E84™ or E88™ (available from Hodogaya Chemical), and the like.

There can also be blended with the toner compositions external additive particles including flow aid additives, which additives may be present on the surface of the toner particles. Examples of these additives include metal oxides like titanium oxide, tin oxide, mixtures thereof, and the like; colloidal silicas, such as AEROSIL®, metal salts and metal salts of fatty acids, including zinc stearate, aluminum oxides, cerium oxides, and mixtures thereof. Each of the external additives may be present in embodiments in amounts of from about 0.1 to about 5 weight %, or from about 0.1 to about 1 weight %, of the toner. Several of the aforementioned additives are illustrated in U.S. Pat. Nos. 3,590,000, 3,800,588, and 6,214,507, the disclosures which are incorporated herein by reference.

The present toners are sufficient for use in an electrostatographic or xerographic process. The present toners generally exhibit a minimum fixing temperature of from about 80 to about 130° C. The present toners exhibit satisfactory properties when used in a xerographic or electrostatographic process. Such properties include a high gloss, which may be in the range of from about 20 to about 60 Garner gloss units (ggu); good charging in high temperature/high- and low-humidity environments; a fusing latitude of 100° C. or more; and substantially no vinyl offset.

The toner particles according to embodiments display non-additive heat cohesions of less than about 50%, and in specific embodiments, of less than about 20%, such as less than about 10% or less than about 5%.

The toner particles of all embodiments may be included in developer compositions. In embodiments, developer compositions comprise toner particles, such as those described above, mixed with carrier particles to form a two-component developer composition. In some embodiments, the toner concentration in the developer composition may range from about 1 to about 25 weight %, or from about 2 to about 15 weight %, of the total weight of the developer composition.

Illustrative examples of carrier particles that can be selected for mixing with the toner include those particles that are capable of triboelectrically obtaining a charge of opposite polarity to that of the toner particles. Illustrative examples of suitable carrier particles include granular zircon, granular silicon, glass, steel, nickel, ferrites, iron ferrites, silicon dioxide, and the like.

The selected carrier particles can be used with or without a coating, the coating generally being comprised of fluoropolymers, such as polyvinylidene fluoride resins; terpolymers of styrene; methyl methacrylate; silanes, such as triethoxy silane; tetrafluoroethylenes; other known coatings; and the like.

In applications in which the described toners are used with an image-developing device employing roll fusing, the carrier core may be at least partially coated with a polymethyl methacrylate (PMMA) polymer having a weight-average molecular weight of 300,000 to 350,000, e.g., such as commercially available form Soken. PMMA is an electropositive polymer that will generally impart a negative charge on the toner by contact. The coating has, in embodiments, a coating weight of from, for example, 0.1 to 5.0 weight %, or 0.5 to 2.0 weight % of the carrier. PMMA may optionally be copolymerized with any desired comonomer, so long as the resulting copolymer retains a suitable particle size. Suitable comonomers can include monoalkyl, or dialkyl amines, such as dimethylaminoethyl methacrylates, diethylaminoethyl methacrylates, diisopropylaminoethyl methacrylates, tert-butylaminoethyl methacrylates, and the like, and mixtures thereof. The carrier particles may be prepared by mixing the carrier core with from, for example, between about 0.05 to about 10 weight % of polymer, and in embodiments, between about 0.05 and about 3 weight % of polymer, based on the weight of the coated carrier particles, until the polymer coating adheres to the carrier core by mechanical impaction and/or electrostatic attraction. Various effective suitable means can be used to apply the polymer to the surface of the carrier core particles, e.g., cascade-roll mixing, tumbling, milling, shaking, electrostatic powder-cloud spraying, fluidized bed, electrostatic disc processing, and with an electrostatic curtain. The mixture of carrier core particles and polymer is then heated to melt and fuse the polymer to the carrier core particles. The coated carrier particles are then cooled and classified to a desired particle size.

Carrier particles can be mixed with toner particles in any suitable combination in embodiments. In some embodiments, for example, about 1 to about 5 parts by weight of toner particles are mixed with from about 10 to about 300 parts by weight of the carrier particles.

In embodiments, any known type of image development system may be used in an image developing device, including, for example, magnetic brush development, jumping single-component development, hybrid scavengeless development (HSD), etc. These development systems are well known in the art, and further explanation of the operation of these devices to form an image is thus not necessary herein. Once the image is formed with toners/developers of the invention via a suitable image development method such as any one of the aforementioned methods, the image is then transferred to an image receiving medium such as paper and the like. In an embodiment of the present invention, it is desired that the toners be used in developing an image in an image-developing device utilizing a fuser roll member. Fuser roll members are contact fusing devices that are well known in the art, in which heat and pressure from the roll are used in order to fuse the toner to the image-receiving medium. Typically, the fuser member may be heated to a temperature just above the fusing temperature of the toner, i.e., to temperatures of from about 80° C. to about 150° C. or more.

Specific examples are described in detail below. These examples are intended to be illustrative, and the materials, conditions, and process parameters set forth in these exemplary embodiments are not limiting. All parts and percentages are by weight unless otherwise indicated.

EXAMPLES

Example 1

Synthesis of an Amorphous Acidic Polyester Resin Having Pendant Carboxylic Acid Groups at an End of the Polyester Resin Chain Using Trimellitic Anhydride A one liter Parr reactor equipped with a heating mantle, mechanical stirrer, bottom drain valve and distillation apparatus was charged with propylene glycol (262 grams), diethylene glycol (28.5 grams), dipropylene glycol (118.5 grams), n-butylstannoic acid (FASCAT 4100) catalyst (0.75 grams), trimethanol propane (6.0 grams) and dimethyl terephthate (436 grams). The reaction was slowly heated to 150° C. over 1 hour under a stream of $CO_2$, with stirring started at 140° C. The temperature is then increased from 150° C. by 15° C. and subsequently 10° C. intervals, every 30 minutes to 180° C. During this time, water and methanol were distilled as a by-product. The temperature was then increased by 5° C. intervals over a 1 hour period to 195° C. The pressure was then reduced to 0.03 mbar over a 2 hour period and any excess glycols were collected in the distillation receiver. The resin was returned to atmospheric pressure and trimellitic anhydride (10.6 grams) was added. The pressure was slowly reduced to 0.03 mbar over 10 minutes and held there for another 50 minutes. The resin was returned to atmospheric pressure and then drained through the bottom drain valve to give a resin with a softening point of 137° C., a glass transition temperature of 58° C. and an acid number of 13.3.

Example 2

Synthesis of a Crystalline Polyester Resin Having Pendant Carboxylic Acid Groups at an End of the Polyester Resin Chain Using Trimellitic Anhydride A one liter Parr reactor equipped with a heating mantle, mechanical stirrer, bottom drain valve and distillation apparatus was charged with dodecanedioic acid (443.6 grams), fumaric acid (18.6 grams), hydroquinone (0.2 grams), n-butylstannoic acid (FASCAT 4100) catalyst (0.7 grams), ethylene glycol (248 grams). The materials were stirred and slowly heated to 150° C. over 1 hour under a stream of $CO_2$. The temperature was then increased by 15° C. and subsequently 10° C. intervals, every 30 minutes to 180° C. During this time, water was distilled as a by product. The temperature was then increased by 5° C. intervals over a 1 hour period to 195° C. The pressure was then reduced to 0.03 mbar over a 2 hour period and any excess glycols were collected in the distillation receiver. The resin was returned to atmospheric pressure under a stream of $CO_2$ and then trimellitic anhydride (12.3 grams) was added. The pressure was slowly reduced to 0.03 mbar over 10 minutes and held there for another 40 minutes. The resin was returned to atmospheric pressure and then drained through the bottom drain valve to give a resin with a viscosity of 87 Pa·s (measured at 85° C.), a melt point of 77.5° C. and a crystallization temperature of 53.7° C.

Example 3

Synthesis of an Amorphous Acidic Polyester Resin Using a Hydroxyl-Terminated Polyester Resin and Polyacrylic Acid A one liter Parr reactor equipped with a heating mantle, mechanical stirrer, bottom drain valve and distillation apparatus was charged with propylene glycol (262 grams), diethylene glycol (28.5 grains), dipropylene glycol (118.5 grams), FASCAT 4100 catalyst (0.75 grams), trimethanol propane (6.0 grains) and dimethyl terephthate (436 grams). The reaction was slowly heated to 150° C. over 1 hour under a stream of $CO_2$, with stirring started at 140° C. The temperature was then increased from 150° C. by 15° C. and subsequently 10° C. intervals, every 30 minutes to 180° C. During this time, water and methanol were distilled as a by product. The temperature was then increased by 5° C. intervals over a 1 hour period to 195° C. The pressure was then reduced to 0.03 mbar over a 2 hour period and any excess glycols were collected in the distillation receiver. The resin was returned to atmospheric pressure and polyacrylic acid (7.0 grams) was added. The pressure was slowly reduced to 0.03 mbar over 10 minutes and held there for another 50 minutes. The resin was returned to atmospheric pressure and then drained through the bottom drain valve to give a resin with a softening point of 132° C., a glass transition temperature of 51° C. and an acid number of 5.6.

Example 4

Synthesis of an Amorphous Acidic Polyester Resin Having Pendant Carboxylic Acid Groups at an End of the Polyester Resin Chain Using Trimellitic Anhydride A one liter Parr reactor equipped with a heating mantle, mechanical stirrer, bottom drain valve and distillation apparatus was charged with propylene glycol (262 grams), diethylene glycol (28.5 grams), dipropylene glycol (118.5 grams), FASCAT 4100 catalyst (0.75 grams), trimethanol propane (11.7 grams) and dimethyl terephthate (436 grams). The reaction was slowly heated to 150° C. over 1 hour under a stream of $CO_2$, with stirring started at 140° C. The temperature is then increased from 150° C. by 15° C. and subsequently 10° C. intervals, every 30 minutes to 180° C. During this time, water and methanol are distilled as a by product. The temperature is then increased by 5° C. intervals over a 1 hour period to 195° C. The pressure was then reduced to 0.03 mbar over a 2 hour period and any excess glycols were collected in the distillation receiver. The resin was returned to atmospheric pressure and trimellitic anhydride (14.1 grams) was added. The pressure was slowly reduced to 0.03 mbar over 1.0 minutes and held there for another 50 minutes. The resin was returned to atmospheric pressure and then drained through the bottom drain valve to give a resin with a softening point of 134.7° C., a glass transition temperature of 55.1° C. and an acid number of 15.43.

Example 5

Emulsion Synthesis

Into a 2 liter beaker, 100 grams of a resin according to Example 1 and 1000 grams of ethyl acetate were charged and stirred to dissolve. In a 4 liter beaker, 1000 grams of water and 2.5 grams of sodium bicarbonate were homogenized at 6400 rpm. Slowly, the resin solution was added, with homogenization continuing for 30 minutes. Ethyl acetate was removed by distillation. Any large particles were removed by screening through a 20 μm screen, followed by centrifuging at 3000 rpm for 3 minutes. A resin emulsion was obtained with a particle size of 200 nanometers as measured Honeywell MICROTRAC® UPA150 particle size analyzer.

Examples 6-8

Emulsion Synthesis

For each of Examples 6-8, emulsion synthesis was conducted according to Example 5, substituting the resins of Examples 2-4, respectively, for that of Example 1.

Example 9

High-Acid Toner Preparation

In a 500-ml beaker, 86.5% by weight of the emulsion of Example 5 (as a 228.63 grams slurry), 9.0% by weight of EE10616 Carnauba Wax (2.5 pph TAYCA POWER surfactant; as a 14.17 gram slurry) and 4.5% by weight of BTD-FX28 PB15:3 cyan pigment dispersion (2.5 pph Tayca Power surfactant; as an 8.18 gram slurry) were mixed together. To this slurry, 1 pph sodium dodecy benzene sulfonate (DOWFAX) surfactant relative to the dry resin weight (25.95 grams) was added as a stabilizer. The pH of the slurry was then adjusted from around pH 3.1 to 2.7. The slurry was then homogenized with an ULTRA-TURRAX T18 Homogenizer, and 1.0% $Al_2(SO_4)_3$ relative to resin, was added dropwise to the slurry over 30 minutes. The doped slurry was transferred to a hot plate and heated to 40° C. while stirring at 940 rpm with an overhead IKA stirrer. The particle size was monitored using AC Counter, MULTISIZER II BECKMAN COULTER. Once the particle size (average particle diameter) $D_{50}$ was around 5.5 μm, the pH of the slurry was increased to 5.0 with 1M LiOH to slow particle growth. Next, 2.6% ethylendiamine tetracetic acid (relative to resin weight), as VERSENE 100, as well as more LiOH to increase the pH of the slurry to 8.9. At this point, the particle size $D_{50}$ was stabilized, and the temperature was slowly ramped to 78° C. Once at 78° C. for 15 minutes, the pH of the slurry was dropped from 6.93 to 6.19 to advance coalescence. The final $D_{50}$ was 7.9 μm with a volume geometric size distribution ($GSD_v$) of 1.36 and a number geometric size distribution) $GSD_n$) of 1.45. The circularity of the toner as measured by the FPIA particle analyzer (Sysmex Corporation) was 0.953 (a perfect sphere having a circularity of 1.000). After cooling, the toner slurry was screened through a 25 μm stainless steel screen having a #500 mesh to remove coarse particles. After settling the toner particles, mother liquor was decanted and the toner was washed with deionized water and acidified to remove excess ions and surfactant. The toner was then redispersed in 200-ml deionized water and freeze dried for 72 hours. The final dry yield of toner was measured to be 23.79 grams.

It will be appreciated that various of the above-discussed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A toner composition comprising toner particles, wherein the toner particles comprise:

a binder;

a colorant; and optionally a wax;

wherein the binder comprises a crystalline polyester resin and an amorphous acidic polyester resin, wherein the amorphous acidic polyester resin has an acid number of from 2.5 to 17 and is a copolyacrylic acid-copolyester resin, the crystalline polyester resin has an acid number of from 1 to 20, and the amorphous acidic polyester resin is prepared by reacting a polyacrylic acid homopolymer having a molecular weight of from 500 to 5000 grams/mole, with hydroxyl end groups of a branched polyester resin, wherein the branched polyester is prepared in the presence of a branching agent in an amount of from about 0.1 to about 5 mole % of the resin.

2. The toner composition according to claim 1, wherein the amorphous acidic polyester resin is a polyester resin that comprises at least one terminal carboxylic acid group.

3. The toner composition according to claim 1, wherein amorphous acidic polyester resin is a polyester resin that comprises from about 0 to about 1 mol % of an alkyl sulfonated moiety.

4. The toner composition according to claim 1, wherein the crystalline polyester resin is present in an amount of about 5 to about 35 wt %, relative to a total weight of the binder.

5. The toner composition according to claim 1, wherein the amorphous acidic polyester resin is present in an amount of about 65 to about 80 wt %, relative to a total weight of the binder.

6. The toner composition according to claim 1, wherein the amorphous acidic polyester resin has an acid number of from 7 to 15.

7. A process for preparing toner compositions, comprising:

providing an amorphous polyester resin;

acidifying end groups of the amorphous polyester resin to produce a amorphous acidic polyester resin that has a terminal pendant acid group;

preparing toner particles including a colorant, a binder comprising the amorphous acidic polyester resin and a crystalline polyester resin, and optionally a wax; and preparing a toner composition including the toner particles; wherein the amorphous acidic polyester resin has an acid number of from 2.5 to 17 and is a copolyacrylic acid-copolyester resin prepared by reacting a polyacrylic acid homopolymer having a molecular weight of from 500 to 5000 grams/mole, with hydroxyl end groups of a branched polyester resin, wherein the branched polyester is prepared in the presence of a branching agent in an amount of from about 0.1 to about 5 mole % of the resin, and the crystalline polyester resin has an acid number of from 1 to 20.

8. The process according to claim 7, wherein providing the amorphous polyester resin comprises preparing the branched polyester resin by polymerizing a glycol monomer.

9. The process according to claim 7, wherein providing the amorphous polyester resin comprises preparing the branched polyester resin by polymerizing a glycol monomer in the presence of the branching agent.

10. The process according to claim 7, wherein the branching agent is chosen from the group consisting of multivalent polyacids, acid anhydrides of multivalent polyacids, lower alkyl esters of multivalent polyacids; multivalent polyols, and mixtures thereof, and trimethylolpropane.

11. The process according to claim 10 wherein the branching agent is trimethylolpropane.

12. The process according to claim 7, wherein the crystalline polyester resin is present in an amount of about 20 to about 35 wt %, relative to a total weight of the binder.

13. The process according to claim 7, wherein the amorphous acidic polyester resin is present in an amount of about 65 to about 80 wt %, relative to a total weight of the binder.

* * * * *